US005187861A

United States Patent [19]

Hillegonds et al.

[11] Patent Number: 5,187,861

[45] Date of Patent: Feb. 23, 1993

[54] WIRE INSERTION HAND TOOL WITH REMOVABLE BENCH MOUNTING ACCESSORIES

[75] Inventors: Larry A. Hillegonds, New Lenox; George H. Jue, Tinley Park; John J. Bulanda, New Lenox, all of Ill.

[73] Assignee: Panduit Corp., Tinley Park, Ill.

[21] Appl. No.: 757,425

[22] Filed: Sep. 10, 1991

[51] Int. Cl.[5] ..... H01R 43/00

[52] U.S. Cl. ..... 29/751; 29/753; 29/760

[58] Field of Search ..... 29/751, 753, 750, 752, 29/760, 281.1

[56] References Cited

U.S. PATENT DOCUMENTS

| | | |
|---|---|---|
| 3,628,202 | 12/1971 | Brown . |
| 3,742,571 | 7/1973 | Brehm . |
| 4,191,442 | 3/1980 | Caveney et al. . |
| 4,286,381 | 9/1981 | Litehizer, Jr. . |
| 4,389,769 | 6/1983 | Casey . |
| 4,575,932 | 3/1986 | Joos et al. . |

*Primary Examiner*—Carl E. Hall

*Attorney, Agent, or Firm*—Charles R. Wentzel; Mark D. Hilliard

[57] ABSTRACT

A wire insertion tool for inserting individual wires into an insulation displacement contact of an electrical connector includes a wire insertion head; a palm handle; a wire insertion punch disposed on a forward end of the palm handle; means for mounting the palm handle to the wire insertion head such that the punch can be reciprocated towards and away from the wire insertion head by grasping the palm handle and the finger grip of the wire insertion head; a connector positioning means for positioning a connector opposite the wire insertion punch; and bench mounting means formed along a distal edge of the wire insertion head for engaging a structural feature on a removable bench mounting block secured to a mounting surface to releasably secure the wire insertion tool to the mounting surface for use as a bench mounted tool. A palm button can be removably mounted to the palm handle when the tool is bench mounted to provide a greater handle surface area.

7 Claims, 7 Drawing Sheets

WIRE INSERTION HAND TOOL WITH REMOVABLE BENCH MOUNTING ACCESSORIES

BACKGROUND OF THE INVENTION

The present invention relates generally to tools for terminating insulated wires in insulation displacement connectors. Specifically, the present invention relates to a hand tool that inserts an insulated wire into conductive engagement with an insulation displacement contact of a connector which includes removable accessories which facilitate the mounting and use of the hand tool as a bench mounted tool.

Many wire insertion tools have been proposed. One such tool proposes the engagement of the tool directly with a support member of a terminal so that none of the forces applied to the wire and the terminal during insertion of the wire are transmitted to the housing in which the terminal is mounted and thus such a tool is not capable of inserting wires into contacts enclosed within the body of a connector. See U.S. Pat. No. 3,628,202.

Other proposed tools are relatively complex requiring the manufacture and assembly of numerous parts and are relatively large and unwieldy to manipulate. See U.S. Pat. No. 3,742,571.

SUMMARY OF THE INVENTION

Among the objects of the present invention are the provision of an improved wire insertion tool having a reduced number of parts that are simply and economically manufactured and assembled, the provision of an improved wire insertion tool that is light in weight and easily manipulated to terminate a wire in a connector, the provision of an improved wire insertion tool that allows termination of a wire that extends outwardly of both sides of the connector into a contact intermediately disposed between previously terminated contacts, and the provision of an improved wire insertion tool that can be easily configured either to be freely manipulated to terminate wires or to be attached to a support surface to provide a bench mount tool.

In general, a wire insertion tool for inserting individual wires into an insulation displacement contact of an electrical connector includes a wire insertion head including a finger grip; a palm handle; a wire insertion punch disposed on a forward end of the palm handle; means for mounting the palm handle to the wire insertion head such that the punch can be reciprocated towards and away from the wire insertion head; a connector positioning means for positioning a connector opposite the wire insertion punch; and bench mounting means formed along a distal edge of the wire insertion head for engaging a structural feature of a mounting surface to secure the wire insertion tool to the mounting surface.

DESCRIPTION OF THE PREFERRED EMBODIMENT

Figure 1:
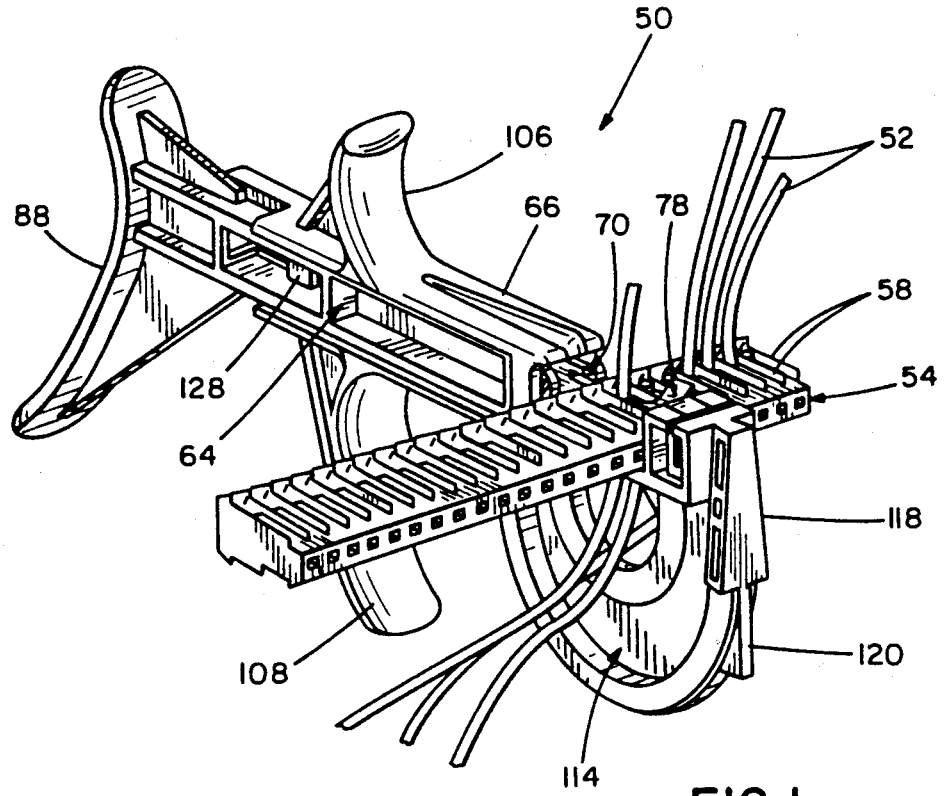
FIG. 1 is a perspective view of a wire insertion tool embodying the concept of the present invention.
Figure 2:
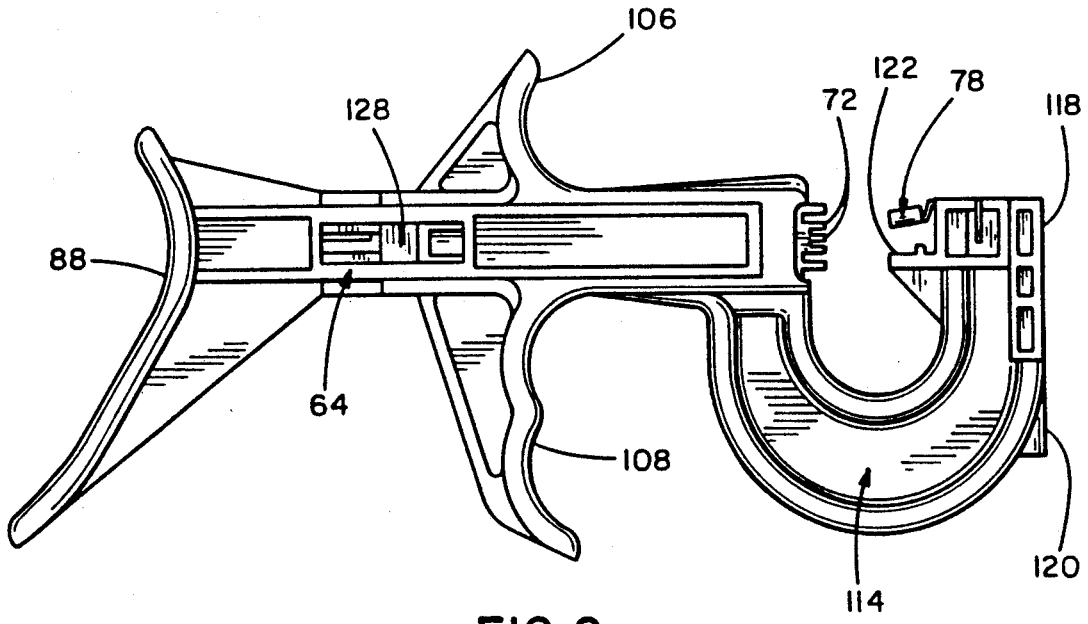
FIG. 2 is a side view of the tool of FIG. 1.
Figure 3:
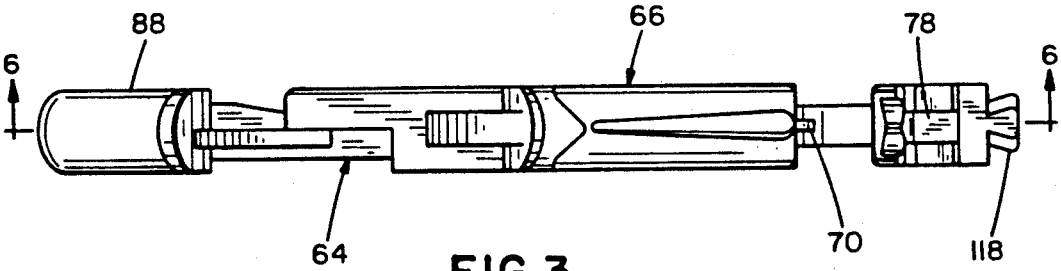
FIG. 3 is a top view of the tool of FIG. 1.
Figure 4:
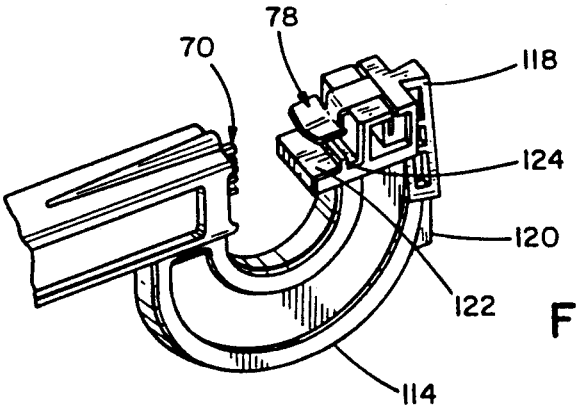
FIG. 4 is a fragmentary perspective of the connector positioning support of the tool of FIG. 1.
Figure 7:
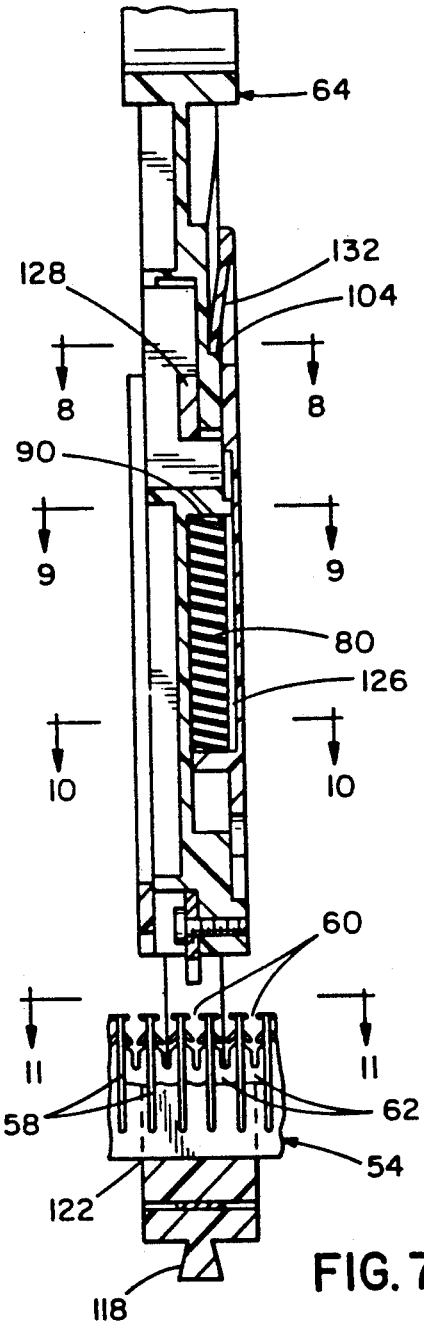
FIG. 7 is a fragmentary sectional view taken along line 7—7 of FIG. 6.

A wire insertion tool embodying the concept of the present invention is designated generally by the numeral 50 in the accompanying drawings. Wire insertion tool 50 is utilized to terminate individual wires 52 within an insulation displacement connector 54 of the type disclosed in detail in U.S. Pat. No. 4,191,442, owned by our common assignee Panduit Corp., which is incorporated herein by reference. As best seen in FIG. 1, connector 54 includes a plurality of parallel spaced apart ribs 58 formed on an upper surface of connector 54 along its length. As best seen in FIG. 7, connector 54 includes a plurality of wire receiving slots 60 each of which includes an insulation displacement terminal 62 that receives and terminates a wire inserted therein.

Figure 5:
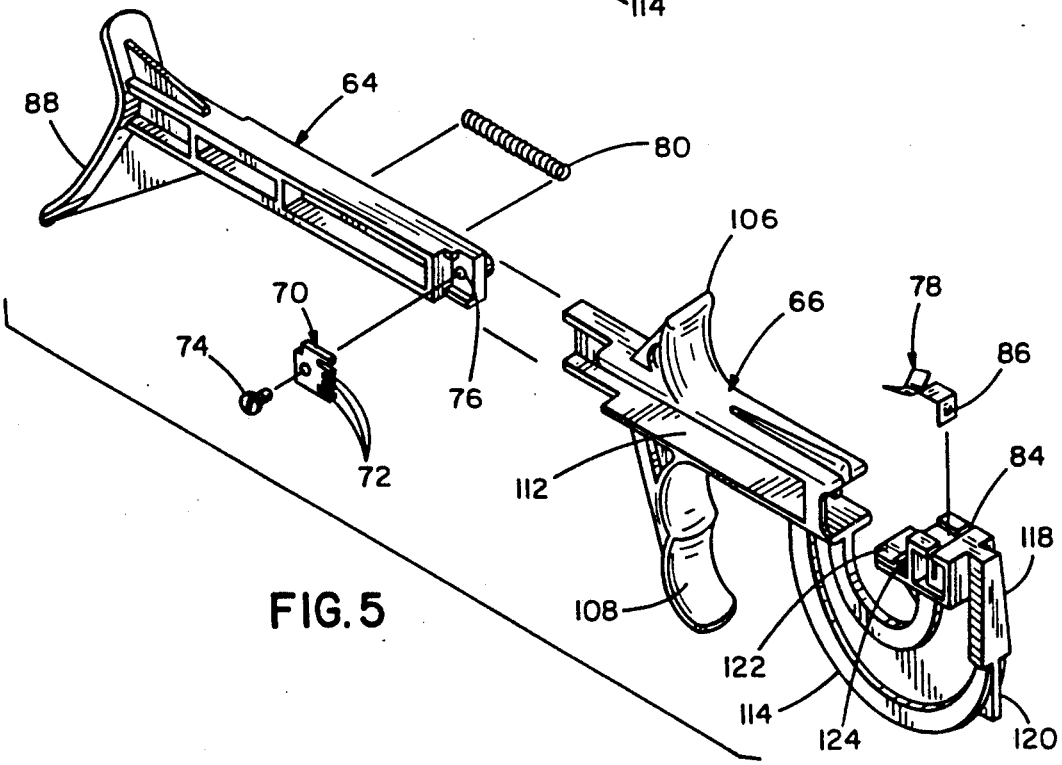
FIG. 5 is an exploded perspective of the tool of FIG. 1.

Tool 50, as seen in FIG. 5, is formed of a limited number of easily and inexpensively manufactured parts, namely: a palm handle 64 and a wire insertion head 66, both inexpensively produced as injection molded plastic parts, a metal wire insertion punch 70 having a plurality of blades 72 contoured to enter each slot 60 of connector 54 to insert each wire 52 into a respective terminal 62, a screw 74 that secures punch 70 on handle 64 in bore 76, a metal wing shaped connector locator spring 78 that is secured in slot 84 in the wire insertion head 66 by a retaining barb 86, and a coil spring 80.

Figure 6:
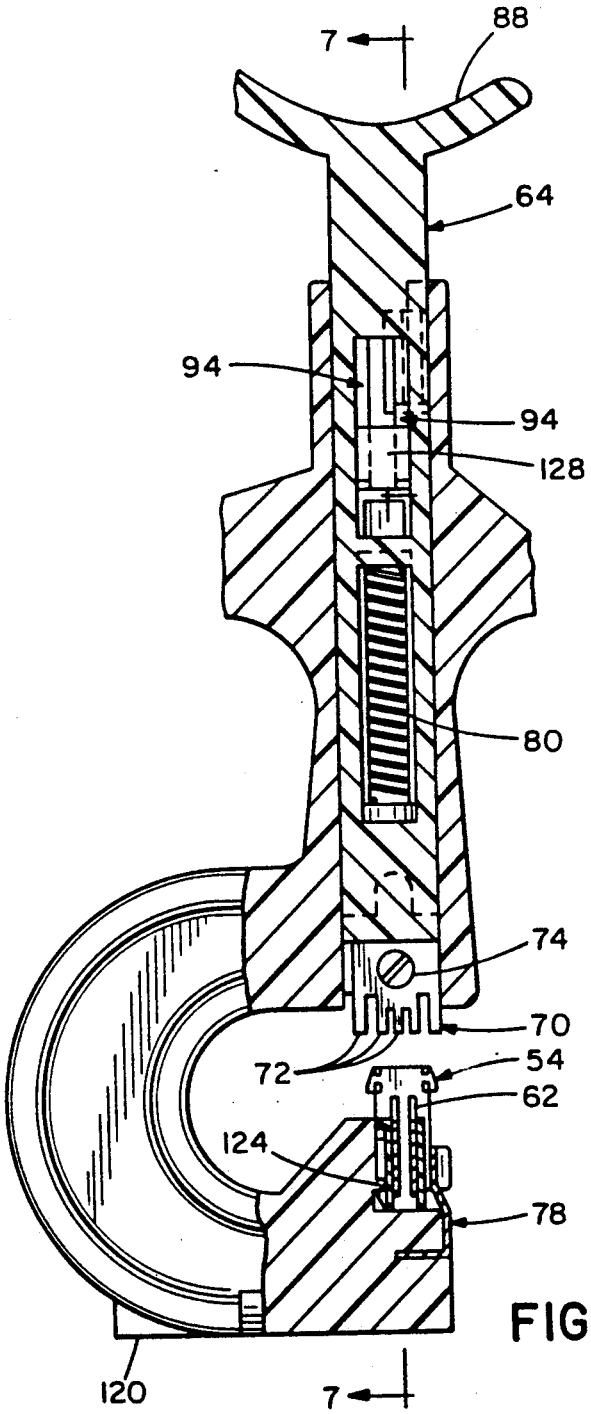
FIG. 6 is a fragmentary sectional view taken along line 6—6 of FIG. 3.
Figure 14:
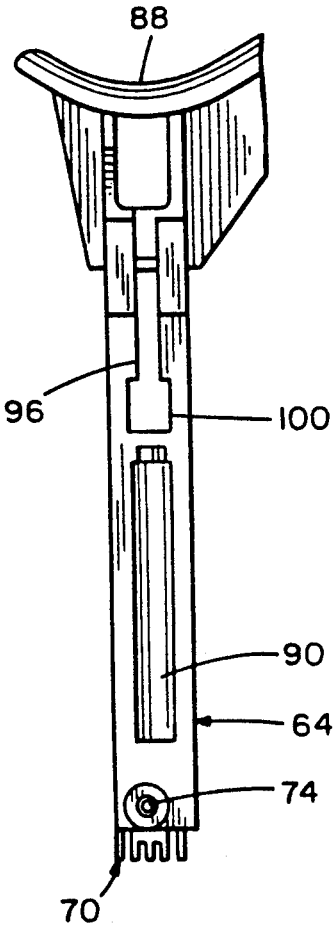
FIG. 14 is a fragmentary side view of the wire insertion palm handle of the tool of FIG. 1.
Figure 15:
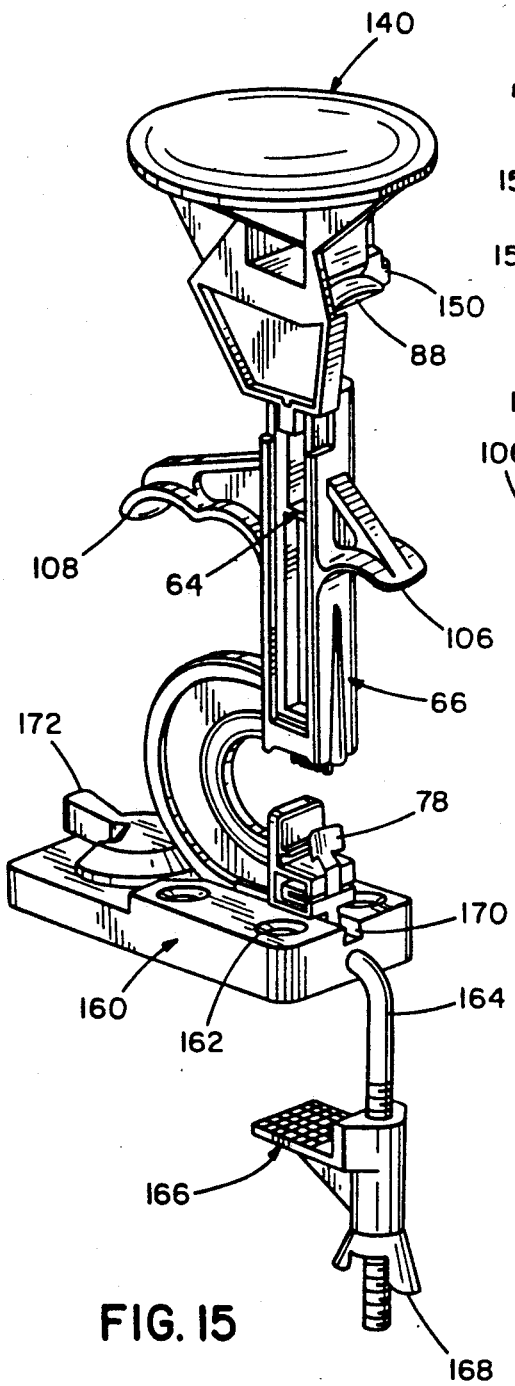
FIG. 15 is a perspective view of the tool of FIG. 1 configured with bench mounting accessories.

Referring to FIGS. 6, 7 and 14, palm handle 64 includes an arcuate flange 88 contoured to be positioned in the palm of an operator's hand, a spring positioning slot 90, lateral tracks 94 which define therebetween an alignment slot 96 which terminates an enlarged rectangular key slot 100. As best seen in FIG. 7, a locking edge 104 is formed in flange 94.

Figure 8:
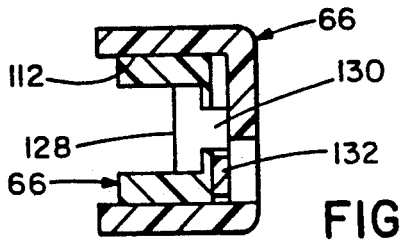
FIG. 8 is a sectional view taken along line 8—8 of FIG. 7.
Figure 9:
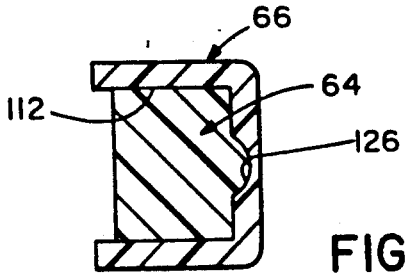
FIG. 9 is a sectional view taken along line 9—9 of FIG. 7.
Figure 10:
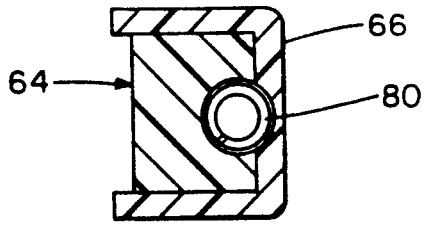
FIG. 10 is a sectional view taken along line 10—10 of FIG. 7.

Referring now to FIGS. 5, 6, 7 and 13, wire insertion head 66 includes first and second finger grips 106 and 108, a palm handle mounting slot 112, an arcuate C-frame 114, a dovetail mounting flange 118 and a positioning flange 120 both formed at the distal peripheral edge of C-frame 114, a connector positioning shelf 122 having a connector positioning rib 124 that engages a slot in connector 54 to slidably position it with respect to tool 50, a spring positioning slot 126, a rectangular mounting boss 128 formed within palm handle mounting slot 112 at the end of stem 130 (see FIGS. 8 and 13), and a resilient cantilever latch 132 disposed to engage edge 104 in lateral flange 94 when palm handle 64 is assembled to wire insertion head 66.

Tool 50 is assembled by securing punch 70 to palm handle 64 with screw 74, positioning coil spring 80 within spring positioning slot 126 of wire positioning head 66, aligning the forward extent of palm handle 64 with palm handle mounting slot 112 of wire insertion head 66 such that rectangular mounting boss 128 is aligned with key slot 100, inserting mounting boss 128 through key slot 100, and sliding mounting boss 128 into alignment slot 96 to overlie lateral tracks 94 (see FIG. 6). As mounting boss 128 is advanced away from key slot 100, the resilient the distal edge of cantilever latch 132, which projects inwardly and is resiliently compressed by initial assembly of handle 64 and head 66, slides past and engages locking edge 104 in one of lateral tracks 94, thus preventing retrograde relative movement and disassembly of handle 64 and head 66. Assembly of tool 50 is completed by inserting wire retaining barb 86 of connector locator spring 78 within slot 84. Spring 80 resiliently biases handle 64 upwardly to an open disposition as shown in FIG. 6, handle 64 being slidably mounted to head 66 such that compression of flange 88 and handles 106 or 108 drives punch 70 towards connector 54 to a fully extended termination position (see FIG. 12).

Figure 11:
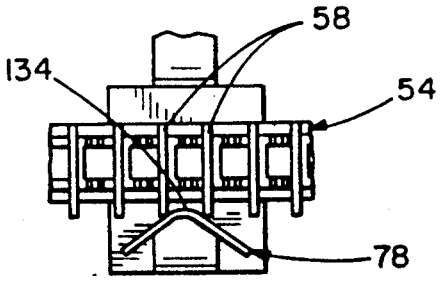
FIG. 11 is a fragmentary view of the connector support of the tool of FIG. 1 as viewed from line 11—11 of FIG. 7.
Figure 12:
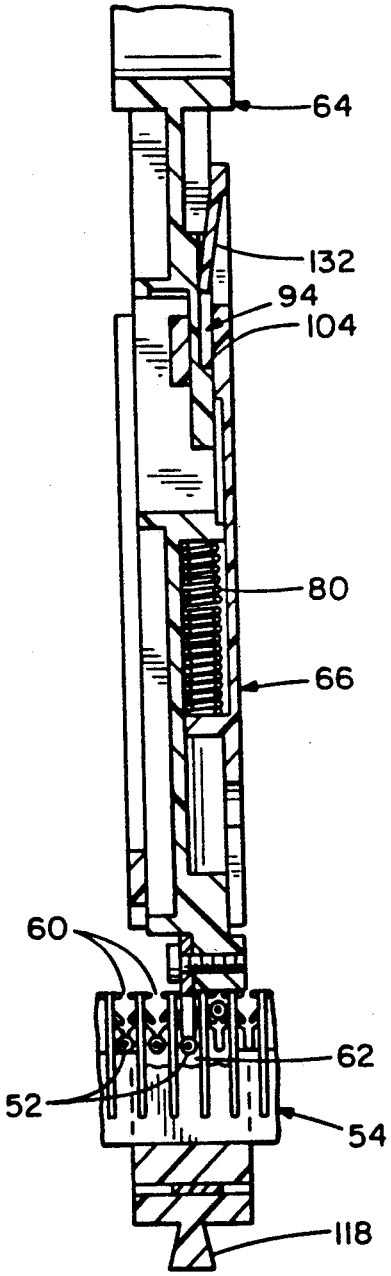
FIG. 12 is a fragmentary sectional view a shown in FIG. 7 showing the tool in a wire insertion position.
Figure 13:
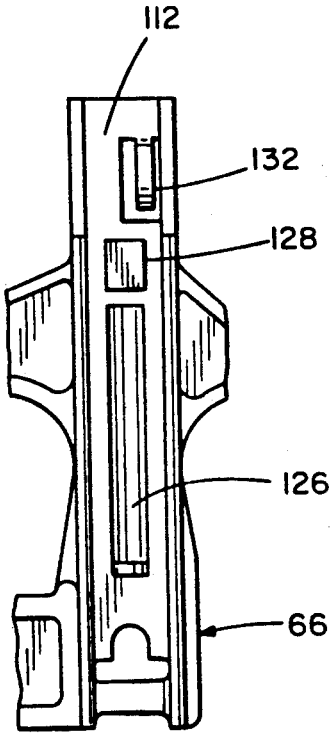
FIG. 13 is a fragmentary side view of the body of the tool of FIG. 1.

As best seen in FIGS. 6, 7 and 12, tool 50 is operated by positioning connector 54 on shelf 122 with the apex 134 of spring 78 (see FIG. 11) positioned between adjacent ribs 58 and resiliently biased thereagainst, adjacent the individual terminal 62 to be terminated. A wire 52 is then positioned adjacent terminal 62 and flange 88 and handles 106 and 108 are grasped and drawn towards each other to drive punch 70 against wire 52 and insert it into terminal 62. See FIG. 12. Connector 54 can then be manually indexed to terminate a wire in the next desired terminal 62.

The shape of C-frame 114 of head 66 provides an open area between connector 54 and opposing punch 70 which allows tool 50 to terminate through connectors having wires 52 which extend through and outwardly of both sides of the connector as illustrated by connector 54 in FIG. 1, wires 52 at one side of connector 54 extending through the open space formed by the C-shaped frame 114. Thus, the C shape of frame 114 allows termination of a wire in a contact of a through connector intermediately disposed between contacts which have been previously terminated to respective wires, with the previously terminated wires extending through the open area as the next contact is terminated.

With reference to FIGS. 15–28, tool 50 is adapted to be configured as a bench mounted tool allowing an operator to secure tool 50 to a working surface thus freeing both of the operator's hands for positioning a wire for termination. Accessories for bench mounting tool 50 include a removable palm button 140 and either a rotary cam tool mounting fixture 160, illustrated in FIGS. 15–22, or a sliding cam tool mounting fixture 144, illustrated in FIGS. 23–28. The major components of palm button 140 and fixtures 160 and 144 are formed of injection molded plastic providing inexpensively manufactured component assemblies.

Figure 16:
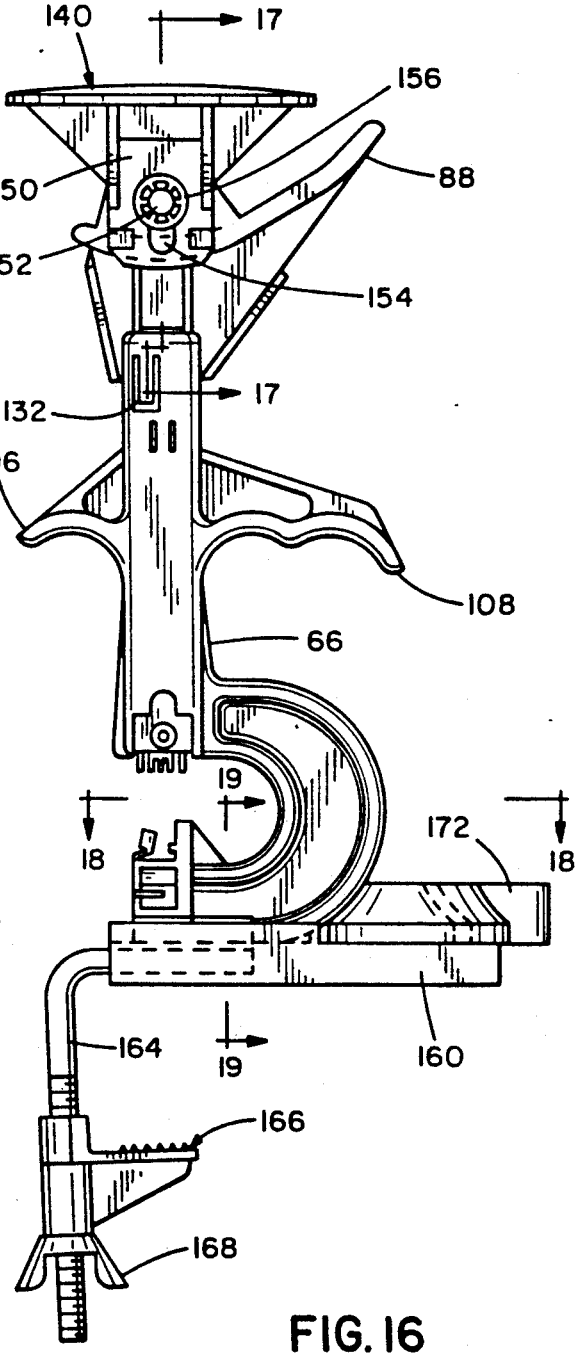
FIG. 16 is a side view of the tool of FIG. 15.
Figure 17:
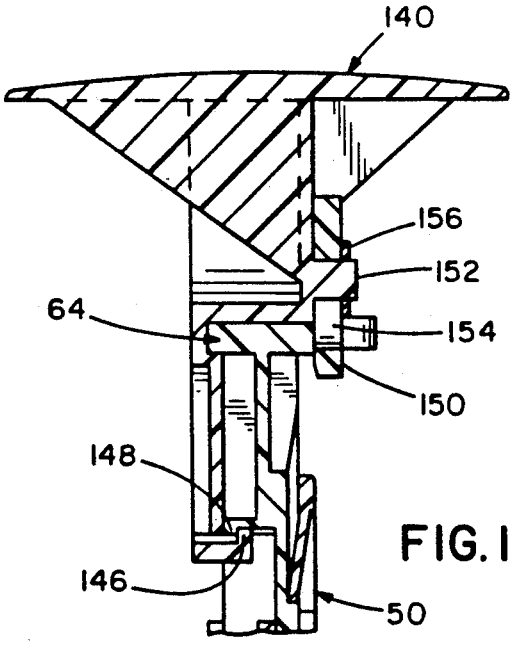
FIG. 17 is a fragmentary sectional view taken along line 17—17 of FIG. 16.
Figure 18:
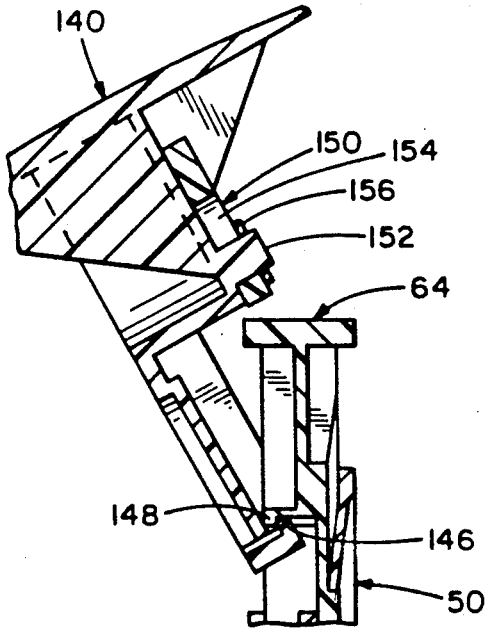
FIG. 18 is a fragmentary section view taken along line 18—18 of FIG. 16.

As seen in FIGS. 17 and 18, palm button 140 is removably secured to tool 50 by engaging a locking edge 146 formed on the distal end of palm button 140 with a corresponding locking edge 148 formed on one side of palm handle 64 and rotating palm button 140 to align a locking slide 150 with the other side of palm handle 64 and sliding slide 150 downwardly to trap the end of palm handle 64 between locking edge 146 and slide 150. As seen in FIG. 16, boss 152 on palm button 140 extends through slot 154 on slide 150 to slidably mount slide 150, retaining washer 156 retaining slide 150 on boss 152. Palm button 140 provides a contoured planar surface having a surface area greater than flange 88 of tool 50 that can be easily actuated by an operator when tool 50 is mounted on a bench to facilitate termination of connector 54.

Rotary cam tool fixture 160 and sliding cam tool mounting fixture 144 both include the common features of a plurality of mounting holes 162, a right angle mounting screw 164 which mounts a bench mounting jaw 166 secured by a wing nut 168, and a tool mounting slot 170 having a dovetail cross section contoured to accept dovetail mounting flange 118 of tool 50.

Rotary cam tool fixture 160 of FIGS. 15, 16 and 19–22, includes a rotary cam 172 mounted for rotary movement by retainer 174 while sliding cam tool mounting fixture of FIGS. 23–28 includes a sliding cam 176 having dovetail edge 178 mounted in slot 180 for sliding movement. Tool mounting slot 170 tapers from a first greater width adjacent each cam 172 or 176 to a lessor width away from each cam 172 or 174 to wedge flange 118 tighter as it is inserted into slot 170.

Figure 20:
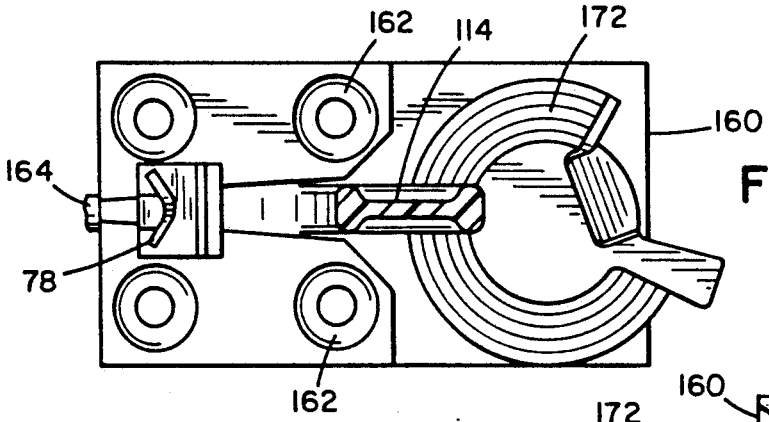
FIG. 20 is a fragmentary sectional view of the tool of FIG. 16 showing a top view of the tool bench mount of the tool in its locked position.
Figure 19:
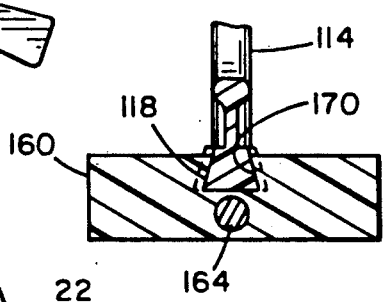
FIG. 19 is a fragmentary sectional view taken along line 19—19 of FIG. 16.
Figure 21:
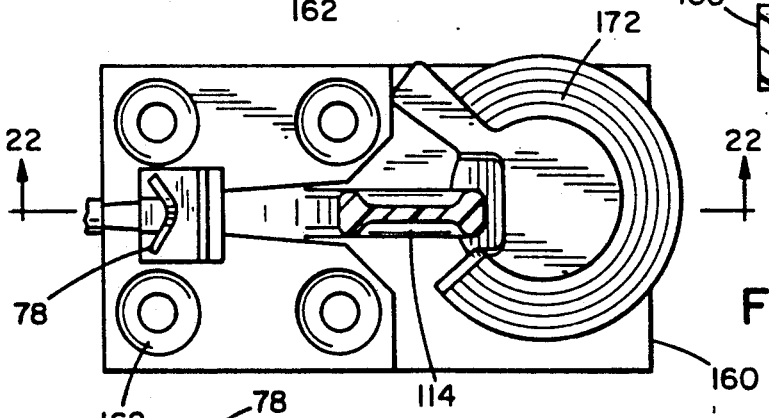
FIG. 21 is the view of FIG. 20 of the tool bench mount in its unlocked position.
Figure 22:
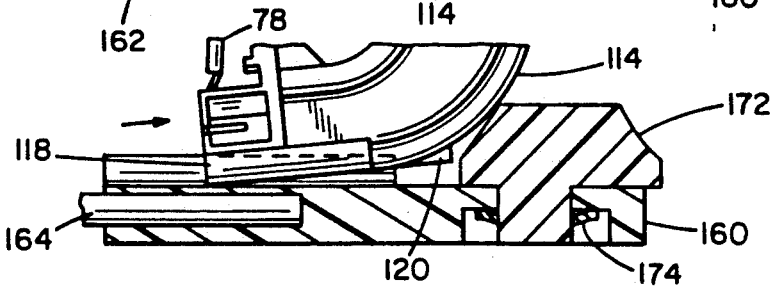
FIG. 22 is a sectional view taken along line 22—22 of FIG.
Figure 23:
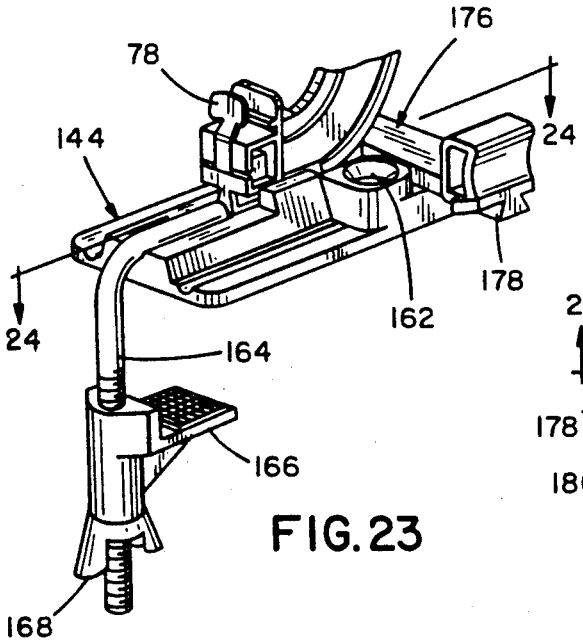
FIG. 23 is a fragmentary perspective view of an alternate embodiment of a tool bench mount.

Tool 50 is mounted within rotary cam tool mounting fixture 160 by inserting dovetail mounting flange 118 into tool mounting slot 170, see FIG. 21, and rotating rotary cam 172 clockwise to position the edge of cam 172 against positioning flange 120 to secure tool 50 to fixture 142, see FIG. 20. Tool 50 is removed by rotating rotary cam 172 counterclockwise and withdrawing tool 50 in the direction of the arrow in FIG. 22.

Figure 24:
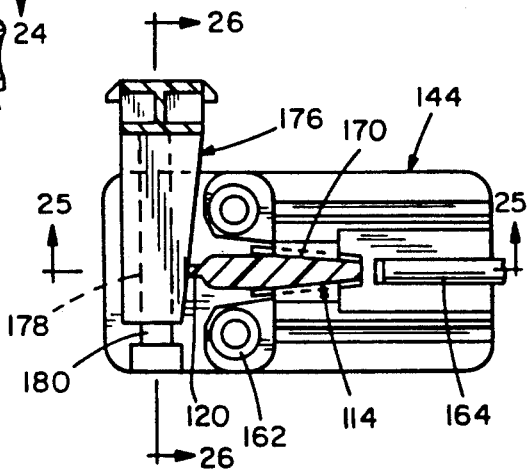
FIG. 24 is a fragmentary sectional view taken along line 24—24 of FIG. 23 showing the tool bench mount of FIG. 23 in its locked position.
Figure 25:
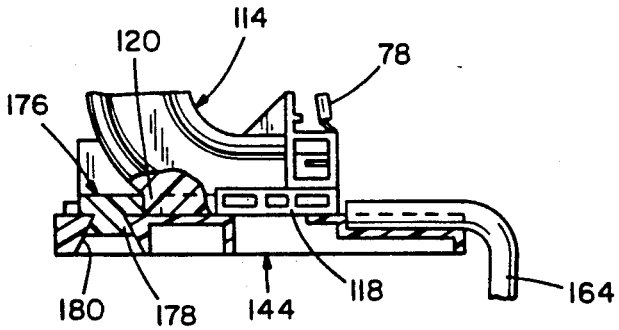
FIG. 25 is a fragmentary sectional view taken along line 25—25 of FIG. 24.
Figure 26:
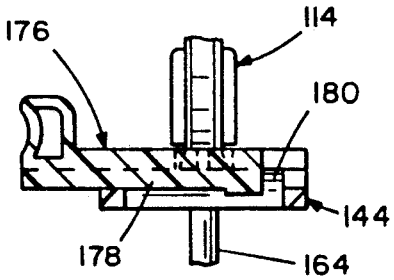
FIG. 26 is a fragmentary sectional view taken along line 26—26 of FIG. 24 showing the locked position.
Figure 27:
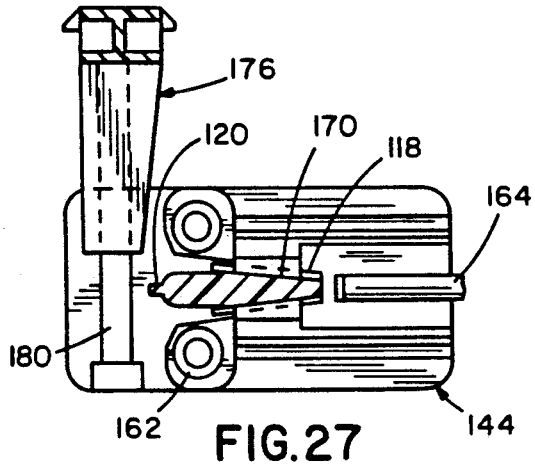
FIG. 27 is the view of FIG. 24 showing the tool bench mount of FIG. 23 in its unlocked position.
Figure 28:
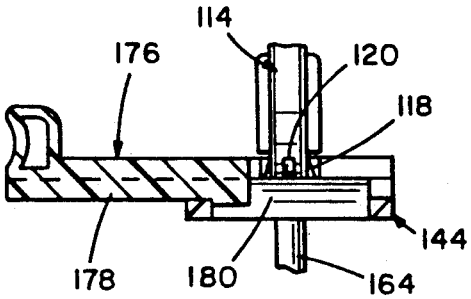
FIG. 28 is the view of FIG. 26 showing the unlocked position.

Tool 50 is mounted to sliding cam tool mounting fixture 144 by inserting dovetail mounting flange 118 into tool mounting slot 170, see FIG. 27 and FIG. 28, and translating sliding cam 176 into abutment with positioning flange 120 to secure tool 50 to fixture 142 as shown in FIG. 24.

Either fixture 142 or 144 can then be secured to a work surface. Thus, tool 50 can be utilized alone as a handle tool or utilized in conjunction with palm button 140 and fixtures 160 or 144 to function as a bench mount tool.

What is claimed is:

1. A wire insertion tool for inserting individual wires into an insulation displacement contact of an electrical connector, comprising:

a wire insertion head including a finger grip;

a palm handle;

a wire insertion punch disposed on a forward end of the palm handle;

means for mounting the palm handle to the wire insertion head such that the punch can be reciprocated towards and away from the wire insertion head;

a connector positioning means for positioning a connector opposite the wire insertion punch; and a removable mounting block having means for securing the mounting block to a mounting surface and bench mounting means extending along a distal edge of the wire insertion head for engaging a structural feature of the removable mounting block to secure the wire insertion tool to the mounting surface and wherein the bench mounting means includes a mounting flange and the structural feature includes a tool mounting slot having a contour complementary to the mounting flange for locking engagement therewith.

2. A wire insertion tool as set forth in claim 1, wherein the mounting block includes a cam fixture movably mounted and disposed to engage the wire insertion tool after insertion of the mounting flange within the tool mounting slot to lock the tool within the tool mounting slot of the mounting block.

3. A wire insertion tool as set forth in claim 2, wherein the movable cam fixture is a rotary cam.

4. A wire insertion tool as set forth in claim 2, wherein the movable cam fixture is a sliding cam.

5. A wire positioning tool as set forth in claim 2, including a palm button having means to removably mount the palm button to the wire insertion tool and a planar surface having a surface area greater than the palm handle of the wire insertion tool, such that a user can more easily actuate the tool when it is secured to a mounting surface.

6. A wire insertion tool as set forth in claim 2, wherein the wire insertion head includes a C-shaped frame connecting the connector positioning means and the wire insertion head such that an inner periphery of the C-shaped frame is spaced from the punch and connector positioning means.

7. A wire insertion tool as set forth in claim 1, wherein the mounting flange has a dovetail contour and wherein the mounting slot tapers from a smaller to a greater width.

* * * * *